United States Patent [19]

Opletal

[11] 4,044,884

[45] Aug. 30, 1977

[54] APPARATUS FOR ORIENTING A FLAT WORKPIECE

[75] Inventor: Josef Opletal, Karl-Marx Stadt, Germany

[73] Assignee: VEB Polygraph Leipzig Kombinat fur Polygraphische Maschinen und Ausrustungen, Leipzig, Germany

[21] Appl. No.: 696,498

[22] Filed: June 16, 1976

[30] Foreign Application Priority Data

June 16, 1975 Germany ..... 186650

[51] Int. Cl.[2] ..... B65G 47/24

[52] U.S. Cl. ..... 198/415; 198/377; 198/413; 198/693; 271/225

[58] Field of Search ..... 198/377, 379, 410, 412, 198/413, 415, 457, 480, 608, 692, 693; 271/80, 184, 225

[56] References Cited

U.S. PATENT DOCUMENTS

| | | | |
|---|---|---|---|
| 2,779,453 | 1/1957 | Lippert et al | 198/377 |
| 3,269,516 | 8/1966 | Lucas | 198/377 |
| 3,321,062 | 5/1967 | Brockmüller et al. | 198/415 |
| 3,367,474 | 2/1968 | Kerr et al. | 198/415 |
| 3,587,824 | 6/1971 | Rochla | 198/377 |
| 3,809,214 | 5/1974 | Reist | 198/415 |
| 3,847,273 | 11/1974 | Buhayar | 198/377 |
| 3,868,009 | 2/1975 | Billi et al. | 198/480 |
| 3,961,698 | 6/1976 | Ahlenius et al. | 198/379 |

FOREIGN PATENT DOCUMENTS

| | | | |
|---|---|---|---|
| 105,186 | 12/1974 | Germany | 198/415 |

*Primary Examiner*—Evon C. Blunk
*Assistant Examiner*—Richard K. Thomson
*Attorney, Agent, or Firm*—Michael J. Striker

[57] ABSTRACT

An apparatus for orienting a flat workpiece has upper and lower hubs rotatable on a support about respective spaced-apart upper and lower rotation axes. Respective radially extending elongated upper and lower arms are mounted on the upper and lower hubs and carry respective upper and lower levers pivotal on these arms about respective upper and lower pivot axes parallel to the upper and lower arms at locations thereon spaced from the upper and lower rotation axes. Respective upper and lower workpiece-engaging needles are mounted on the upper and lower levers at substantially like spacings from the upper and lower rotation axes. Each lever is pivotal between an operative position with the respective needle engageable with the workpiece and an inoperative position unengageable with the workpiece and can be locked in the operative position by locking means. Upper and lower cam followers on the upper and lower levers are engageable respectively with an upper cam on the second arm and a lower cam carried on the support. Each cam follower is only engageable with the respective cam in a position wherein the two arms extend parallel to and one immediately above the other. A plurality of such upper arms may be provided on the upper hub and a plurality of such lower arms on the lower hub, with each lower arm carrying a respective upper cam, but only one lower cam being provided on the apparatus.

10 Claims, 4 Drawing Figures

APPARATUS FOR ORIENTING A FLAT WORKPIECE

BACKGROUND OF THE INVENTION

The present invention relates to an apparatus for orienting a flat workpiece. More particularly this invention concerns such an apparatus which is used to swing a workpiece such as a sheet of paper of the like through 90° about an axis orthogonal to the plane of the workpiece relative to a transport direction.

In various paper-processing operations a sheet or foil of paper constituting a flat workpiece is displaced in a longitudinal direction parallel to its plane and parallel to two of the sides of the workpiece. It is frequently necessary to pivot this workpiece through exactly 90° in order to fold it, print it or otherwise treat it. Such a process is described in German Democratic Republic Pat. No. 105,186.

Such a workpiece-orienting apparatus is known which comprises a pair of hubs rotatable about respective vertical and parallel axes and each carrying a plurality of arms of like diameter so as to form a pair of like rotatable stars. These hubs are rotated in the same direction at the same speed and each of the arms carries at its outer end a workpiece-engaging element. The hubs are rotated so that the peripheral speeds of the workpiece-engaging elements is equal to the displacement speed of the conveyor-belt feed system for the flat workpieces.

In such a system these workpiece-engaging elements are constituted as needles with upwardly directed sharp points and the one star is located above the other so that the two can rotate independently of each other.

At least the uppermost needle is controlled by means of a cam and lever mechanism which displaces the needle vertically through a distance equal to the desired penetration depth and the thickness of the arm. The cam of such a system is typically formed as a circle segment which is extremely difficult and expensive to machine. In fact due to the structure of such systems it is typically necessary to form it as a part-spherical surface which again considerably increases construction cost. In addition the relatively loose mounting of the lower cam on the bearing of the chain sprocket secured to the lower star frequently leads to inexact operation of the respective needle so that turning through exactly 90° is not insured, and tearing or other damaging of the workpiece is possible.

SUMMARY OF THE INVENTION

It is therefore an object of the present invention to provide an improved workpiece orienting apparatus.

Yet another object is the provision of such a device which operates surely and accurately to rotate a workpiece through a predetermined angular distance.

Another object is the provision of such an apparatus which uses cams that can be machined at substantially lower cost than the prior-art devices.

These objects are attained according to the present invention in an apparatus for orienting a flat workpiece which comprises a support and first and second hubs rotatable on this support about respective spaced-apart first and second rotation axes. Radially extending elongated first and second arms are mounted on the first and second hubs and respective first and second levers are pivotal on these first and second arms about respective first and second pivot axes parallel to the arms at locations thereon spaced from the first and second rotation axes. First and second workpiece-engaging elements are mounted on the first and second levers at substantially like spacings from the first and second rotation axes and respective first and second cam followers are also provided on these first and second levers which are each pivotal between an operative position with the respective workpiece-engaging element engageable with a workpiece and an inoperative position with this element unengageable with a workpiece. A first cam is provided on the second arm engageable in a predetermined angular position of the first and second arms with the first cam follower to pivot the first lever from its inoperative into its operative position. A second cam is provided on the support engageable in the predetermined angular position of the arms with the second cam follower to pivot the second lever from its inoperative into its operative position. Respective first and second locking means are provided on the arms each operable for maintaining the respective levers in their operative positions for a predetermined angular travel of the respective lever from the above-mentioned predetermined position. The hubs are rotated about their rotation axes in the same direction so that the elements move at the same peripheral speed. The term "orienting" therefore here refers to the orienting of the flat workpiece relative to its transport direction, since the workpiece itself retains the same absolute orientation relative to a fixed point, but is moving in a direction 90° offset from its original displacement direction after leaving the apparatus.

The length of the effective portion of the second cam, that is that portion with which the second cam follower is in engagement during displacement of the second element into the operative position, corresponds to the duration of the workpiece-engagement operation, here the penetration of the element into the workpiece. The relationship of the effective length of the two cam members is equal to the ratio between the peripheral speed of the second element and the relative speeds between the first and second arms when in their predetermined position parallel to and one above the other. Similarly the relative speed between the arms is equal to the ratio of the distance of the axes and the lengths of both stars.

In accordance with another feature of this invention the first cam is displaceable on the second arm in a direction transverse to the longitudinal direction of this arm. Thus it is possible to vary the instant of time at which the needle constituting the first element will pierce the workpiece. A screw is provided between this first cam and the second arm in order to vary the position and maintain any of a plurality of positions.

With the system according to the present invention it is therefore possible to dispense with the complicated cam arrangement on which the cam follower of each lever rides continuously. A short cam is simply provided for each of the levers to move the respective element into the operative position. The locking means, constituted as the simple spring-loaded pawl on each arm, then serves to hold the respective element in the operative position until it engages with further means that allow the lever to slip back into the inoperative position. This last-mentioned means may be constituted by first and second trippers fixed on the apparatus support at respective locations 90° offset from the second cam relative to the respective rotation axes.

According to further features of this invention each of the levers is provided with a respective turn spring which urges it into the inoperative position. This arrangement assures that accidental tripping of these levers or engagement with a workpiece is ruled out. Furthermore the relatively common accident of the element of the lower arm engaging with the upper arm is herewith completely eliminated.

A holder in accordance with another feature of this invention is provided on each of the levers for the respective element so that the extend to which this element projects axially can be varied. Such an arrangement also readily allows the elements to be exchanged for others in case workpieces of other material are to be oriented by the apparatus.

A plurality of first arms may be provided angularly equispaced about the first hub and a plurality of second arms angularly equispaced about the second hub. Each of the arms has a respective lever, element, follower and locking means. Furthermore each of the second arms is provided with a respective first cam.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF THE PREFERRED EMBODIMENT

Figure 1:
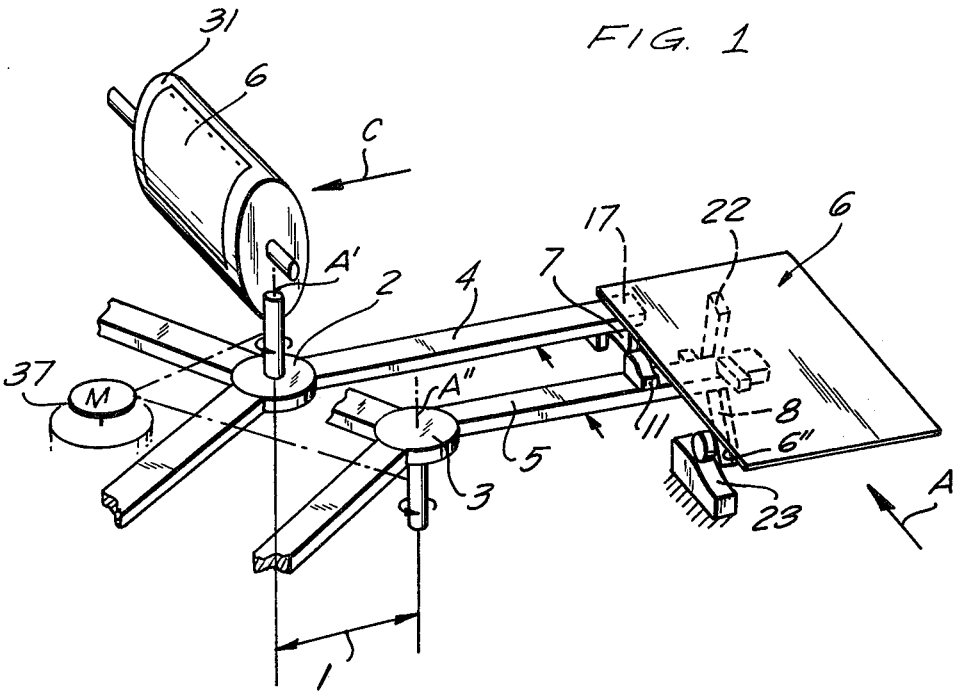
FIG. 1 is a perspective partly schematic view illustrating the apparatus according to this invention.

As shown in FIG. 1 a pair of hubs 2 and 3 are rotatable by a motor 37 about respective vertical axes A' and A" spaced apart by a horizontal distance 1. These hubs 2 and 3 each carry three radially extending arms 4 and 5, respectively, and lever arrangements 7 and 8 on the outer ends of these arms are adapted to pick up a flat workpiece 6 arriving in a direction A and deliver it to a processing station in a direction C, the leading edge 6' of the workpiece 6 thereby becoming a side edge and a side edge 6" becoming the leading edge as it departs in the direction C.

Figure 2:
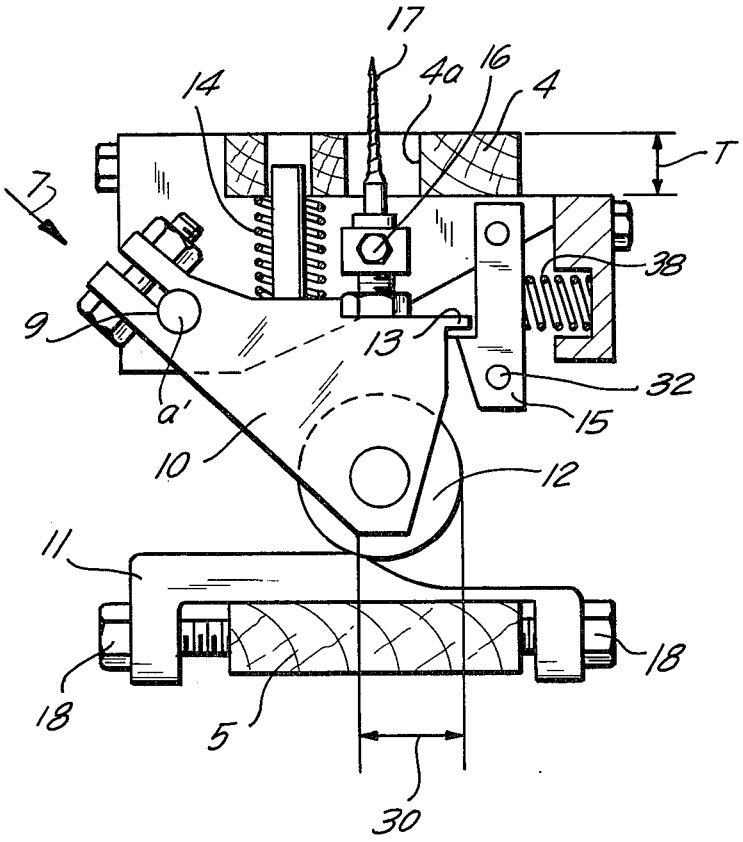
FIG. 2 is a vertical section taken through the apparatus of FIG. 1 showing the upper or first lever arrangement.

The lever arrangement 7 comprises a lever 10 displaceable on a pivot 9 defining a pivot axis *a'* parallel to the arm 4 and carrying a cam-follower roller 12 rotatable about a roller axis parallel to the axis *a'* and a holder 16 for a needle 17 engageable up through a hole 4*a* n the arm 4. The holder 16 is adjustable so that the height of the sharpened point of the needle 17 above the arm 4 in either the illustrated operative position or the inoperative position can be preset. In addition the lower arm 5 carries a cam 11 displaceable in a direction transverse to this lower arm 5 by means of adjustment screws 18 bearing on opposite sides of the lower arm 5. The roller 12 is engageable with this cam 11 through a distance 30 that determines in accordance with the relative speeds of the two arms 4 and 5 when one lies directly above the other as shown in FIG. 2 the length of time it takes the needle 17 to pierce a workpiece. In addition a spring 14 bears between the lever 10 and the arm 4 and normally urges it into the inoperative or down position. Another spring 38 bears against a dog or pawl 15 which can engage under a lip 13 on the lever 10 in order normally to hold it in the illustrated operative position after the roller 12 has moved out of engagement with the cam 11. A tripper 35 mounted on the fixed support 36 of the apparatus is engageable with a pin 32 on this locking dog 12 to pull it away from the lever 10 and allow the spring 14 to push the lever 10 down into the inoperative position.

Figure 3:
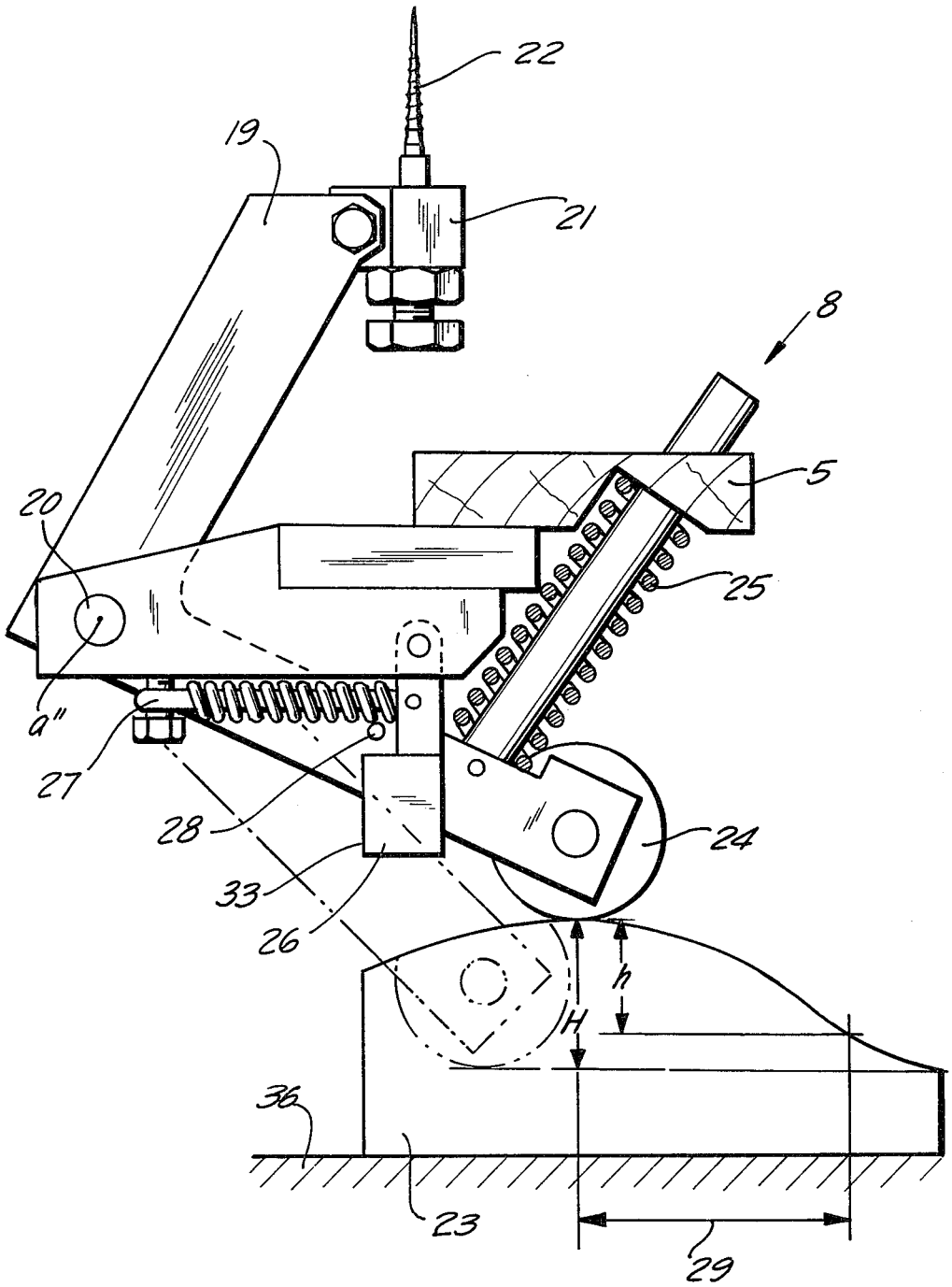
FIG. 3 is a similar section showing the lower or second lever arrangement.

As shown in FIG. 3 the lever arrangement 8 comprises a two-arm lever 19 pivoted on a pin 20 defining a pivot axis *a"* parallel to the respective arm 5. A compression spring 25 normally urges the lower arm of this lever 19 downwardly so that a roller cam follower 24 thereon identical to the roller 12 is pressed downwardly toward a cam 23 fixed on the support 36 of the apparatus. Only one such cam 23 is provided for the apparatus, and although the roller 24 is engageable with it for lifting through a distance H substantially greater than the thickness T (see FIG. 2) of the arm 4, it need only lift through a distance h over an effective length 29. An adjustable holder 21 identical to the holder 16 holds a respective needle 22 which may be reciprocated vertically through the distance H which is equal to the thickness T of the arm 4 plus the desired penetration distance into the workpiece 6. A tension spring 27 pulls a locking pawl 26 under a pin 28 provided on the lower arm of the lever 19. A tripper 34 (FIG. 4) is engageable with the face 33 of this pawl 26 so as to pivot it backwardly and allow the spring 25 to push the arm 19 downwardly.

Figure 4:
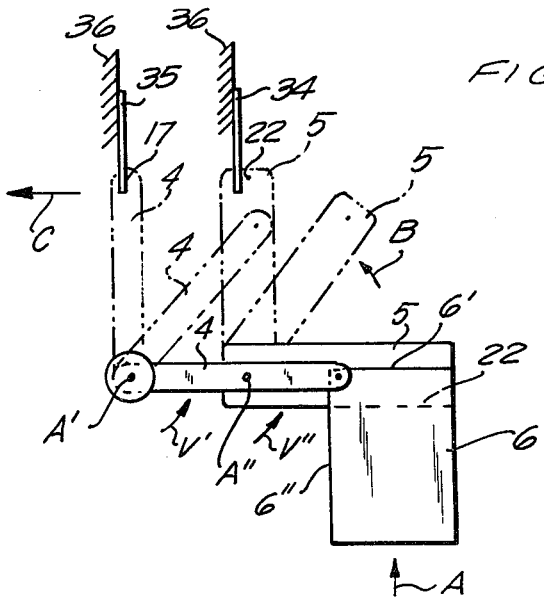
FIG. 4 is a schematic top view illustrating operation of the system according to the present invention.

The device described above operates as follows:

As shown in FIG. 4 the two arms 4 and 5, the latter being shown to be thicker than the former for sake of illustration, are rotated about their respective axes A' and A" as shown by the arrows V' and V" at the same angular and peripheral speed. The needles 17 and 22 have their tips equispaced from the axes A' and A" so that they are spaced apart by the distance 1 in the solid-line position of FIG. 4 wherein the arm 4 directly overlies and is parallel to the arm 5.

The workpiece is fed in as shown by arrow A at a speed which is exactly equal to the peripheral velocity of the two needles 17 and 22. These two needles 17 and 22 are in the overlying position illustrated in solid lines in FIG. 4 pressed upwardly by the cams 11 and 23 so as to pierce and engage into the workpiece 6 at the leading edge 6' thereof.

Continued rotation of these arms 4 and 5 through 45° as illustrated in dot-dash lines in FIG. 4 will hold the two points 17 and 22 parallel to each other but will tend to displace the workpiece 6 in a direction B at 45° to the direction A.

Further rotation through yet another 45° will place the arms 4 and 5 in the positions indicated in the dash-dot-dot lines in FIG. 4. In this position the line defined by the points 17 and 22 is parallel to the line they defined in the solid-line position, but the workpiece is being displaced in a direction C exactly 90° offset from the direction A. At this instant the two trippers 34 and 35 mounted on the workpiece support engage the elements 33 and 15, respectively, and allow the springs 25 and 14 to press the needles 22 and 17 downwardly and out of engagement with the workpiece 6' whose side edge 6" is now leading in the displacement direction C. The workpiece may then be treated at the station 31, folded, or subjected to any suitable further operation.

Thus with the system according to the present invention a single fixed cam 23 is provided for operating the workpiece-engaging element 22 and four relatively simple and easy-to-machine cams 11 are provided to raise and lower the workpiece-engaging element 17. The operation of the device will be sure and easy to adjust. Furthermore the possibility that the lower pin 22 catches on one of the upper arms 4 is almost entirely ruled out, as the trippers 34 and 35 will insure that when the lower needle 22 must pass below one of the upper arms 4 it is retracted.

It will be understood that each of the elements described above, or two or more together, may also find a useful application in other types of mechanisms differing from the types described above.

While the invention has been illustrated and described as embodied in a workpiece-orienting apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for orienting a flat workpiece, said apparatus comprising: a support; first and second hubs rotatable on said support about respective spacedapart first and second rotation axes; respective radially extending elongated first and second arms mounted on said first and second hubs; respective first and second levers pivotal on said first and second arms about respective first and second pivot axes parallel to said first and second arms at locations thereon spaced from said first and second rotation axes; respective first and second workpiece-engaging elements mounted on said first and second levers at substantially like spacings from said first and second rotation axes, each lever being pivotal between an operative position with the respective element engageable with a workpiece and an inoperative position unengageable with a workpiece; respective first and second cam followers on said first and second levers; a first cam on said second arm engageable in a predetermined angular position of said first and second arms with said first cam follower to pivot said first lever from its inoperative into its operative position; a second cam on said support engageable in said predetermined angular position of said arms with said second cam follower to pivot said second lever from its inoperative into its operative position; respective first and second locking means on said arms each operable for maintaining the respective levers in their operative positions for a predetermined angular travel of the respective lever from said predetermined position; and means for rotating said hubs about their rotation axes in the same direction.

2. The apparatus defined in claim 1, further comprising means including respective first and second return springs on said first and second arms for urging said levers into said inoperative positions.

3. The apparatus defined in claim 1, further comprising means for displacing said first cam on said second arm in a direction transverse to said second arm.

4. The apparatus defined in claim 3, wherein said second cam is a block having a curved upper surface, said means for displacing including a screw extending transverse to said second arm and between said block and said second arm.

5. The apparatus defined in claim 1, wherein each of said elements is formed with a sharp upwardly directed points.

6. The apparatus defined in claim 5, further comprising means including a holder on each of said levers for each of said elements for holding the respective element in any of a plurality of vertically offset positions.

7. The apparatus defined in claim 1, wherein said locking means each include a pawl pivoted on the respective arm and engageable under the respective lever.

8. The apparatus defined in claim 1, wherein each of said cam followers is a roller rotatable about a roller axis parallel to the respective arm.

9. The apparatus defined in claim 1, wherein each of said hubs is provided with a plurality of such arms each having respective levers, elements, followers and locking means.

10. The apparatus defined in claim 1, wherein in said predetermined position of said arms said elements are spaced apart by a distance substantially equal to the spacing between said first and second rotation axes.

* * * * *